US008496511B2

(12) United States Patent
Laraia et al.

(10) Patent No.: US 8,496,511 B2
(45) Date of Patent: Jul. 30, 2013

(54) CATHODICALLY-PROTECTED PAD CONDITIONER AND METHOD OF USE

(75) Inventors: Vincent J. Laraia, Houlton, WI (US); Boon Kiat Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 448 days.

(21) Appl. No.: 12/837,055

(22) Filed: Jul. 15, 2010

(65) Prior Publication Data

US 2012/0015589 A1 Jan. 19, 2012

(51) Int. Cl.
*B24B 1/00* (2006.01)
*B24B 53/00* (2006.01)

(52) U.S. Cl.
USPC ..... 451/56; 451/41; 451/72; 451/443; 451/539

(58) Field of Classification Search
USPC ..... 451/21, 41, 56, 72, 443, 533, 539, 451/548
See application file for complete search history.

(56) References Cited

U.S. PATENT DOCUMENTS 2,817,634 A 12/1957 McCall
3,022,234 A 2/1962 Anderson
5,352,342 A 10/1994 Riffe
5,620,489 A 4/1997 Tselesin
6,123,612 A 9/2000 Goers
6,203,413 B1 3/2001 Skrovan
6,264,536 B1 * 7/2001 Crevasse et al. ..... 451/41
7,125,324 B2 10/2006 Palmgren et al.
7,285,203 B2 10/2007 Russell et al.
7,468,321 B2 12/2008 Ching et al.
7,608,173 B2 10/2009 Manens et al.

FOREIGN PATENT DOCUMENTS

WO WO 2005/113193 A1 12/2005

OTHER PUBLICATIONS

International Search Report, PCT/US2011/041843, mailed Dec. 9, 2011, 4 pages.
Written Opinion of the International Searching Authority, PCT/US2011/041843, mailed Dec. 9, 2011, 6 pages.

* cited by examiner

*Primary Examiner* — Timothy V Eley
(74) *Attorney, Agent, or Firm* — Bradford B. Wright

(57) ABSTRACT

A cathodically-protected pad conditioner for chemical mechanical planarization includes: an abrasive member including a metallic substrate, a support carrier, and an anode affixed to the peripheral edge of the support carrier. A cathodic protection circuit is configured to provide a cathodic protection current from the anode to the abrasive member if contacted with an electrolyte solution. A method of using the cathodically-protected pad conditioner is also disclosed.

7 Claims, 2 Drawing Sheets

CATHODICALLY-PROTECTED PAD CONDITIONER AND METHOD OF USE

TECHNICAL FIELD

The present disclosure relates broadly to pad conditioners for chemical mechanical planarization of semiconductor wafers and methods of their use.

BACKGROUND

Chemical Mechanical Planarization (CMP) is a widely-used processing technique in the manufacturing of submicron technology integrated circuits (ICs). With ever-decreasing lithographic depth of focus as technology nodes shrink, planarity of the semiconductor wafer working surface has become a necessity. CMP is a polishing/material-removal process in which a polishing pad and a polishing slurry are used. The polishing slurry is often corrosive. Due to glazing, the material removal efficiency of polishing pads usually declines after prolonged use. To maintain a constant material removal efficiency, a pad conditioner is used to unglaze (i.e., condition) the polishing pad.

During wafer planarization, certain issues arise including microscratching (i.e., micrometer scale scratches), under or over-polishing, and dishing. Main contributors to microscratching include abrasive particles from the slurry, loose materials from polishing, loose diamonds from pad conditioners, and metal particles from the pad conditioner.

In addition to microscratching, some metals such as, for example, nickel may pose a contamination issue. For example, embedded nickel particles in the wafer surface may result in shifts in electrical or reliability performance of active/passive devices and interconnects. For example, the electrical performance of a metal-oxide-semiconductor field-effect transistor (MOSFET) can be adversely affected by nickel contamination. Also, copper interconnects can become electrical short circuited when nickel contamination causes electrical bridging between separate copper traces.

SUMMARY

In one aspect, the present disclosure provides a cathodically-protected pad conditioner for chemical mechanical planarization comprising:

an abrasive member comprising a metallic substrate having an abrasive surface and a back surface opposite the abrasive surface, wherein the abrasive surface comprises abrasive particles affixed to the metallic substrate;

a support carrier having a receiving surface and a peripheral edge adjacent the receiving surface, wherein the receiving surface is affixed and adjacent to the back surface of the abrasive member;

an anode affixed to the peripheral edge; and a cathodic protection circuit configured to provide a cathodic protection current from the anode to the metallic substrate if contacted with an electrolyte solution.

In some embodiments, the cathodic protection circuit comprises an electric cell having positive and negative terminals, wherein the positive terminal is electrically coupled to the anode, and wherein the negative terminal is electrically coupled to the metallic substrate. In some embodiments, the electric cell is at least partially disposed within a cavity in the support carrier. In some embodiments, the negative terminal is at least partially affixed to the metallic substrate by conductive adhesive. In some embodiments, the peripheral edge has a beveled portion adjacent the abrasive member, and the anode is disposed on the beveled portion.

Advantageously, cathodically-protected pad conditioners according to the present disclosure are inhibited with respect to oxidation of the metallic substrate during chemical mechanical planarization of a semiconductor wafer that may result in microscratches on, and/or contamination of, the semiconductor wafer.

Pad conditioners according to the present disclosure are useful, for example, for use during chemical mechanical planarization of a semiconductor wafer. Accordingly, in another aspect, the present disclosure provides a method of conditioning a pad, the method comprising using a pad conditioner according to the present disclosure during chemical mechanical planarization of a semiconductor wafer. In some embodiments, the cathodically-protected pad conditioner contacts the pad during chemical mechanical planarization of a semiconductor wafer.

The foregoing embodiments may be implemented in any combination thereof, unless such combination is clearly erroneous in view of the teachings of the present disclosure. The features and advantages of the present disclosure will be further understood upon consideration of the detailed description as well as the appended claims.

While the above-identified drawing figures set forth several embodiments of the present disclosure, other embodiments are also contemplated, as noted in the discussion. In all cases, this disclosure presents the disclosure by way of representation and not limitation. It should be understood that numerous other modifications and embodiments can be devised by those skilled in the art, which fall within the scope and spirit of the principles of the disclosure. The figures may not be drawn to scale. Like reference numbers may have been used throughout the figures to denote like parts.

DETAILED DESCRIPTION

Figure 1:
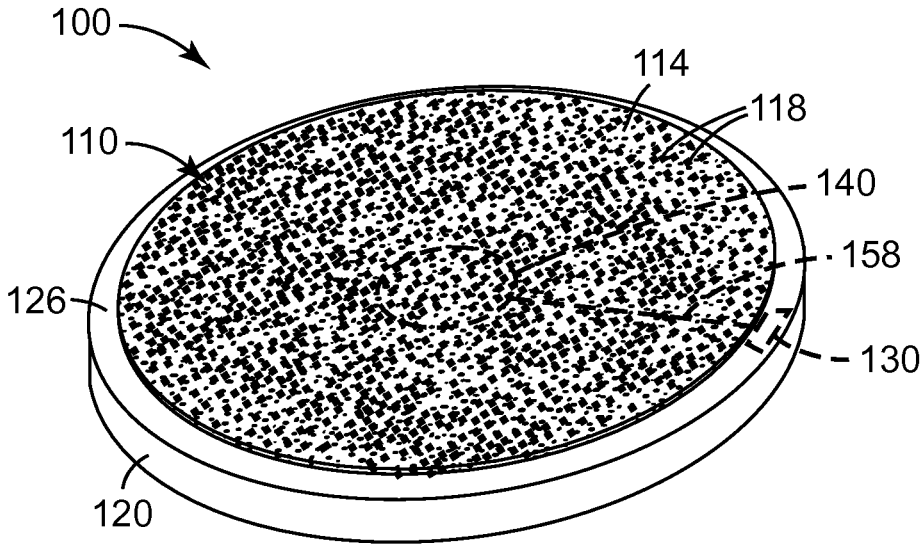
FIG. 1 is a perspective view of an exemplary pad conditioner 100 according to one embodiment of the present disclosure.
Figure 2:
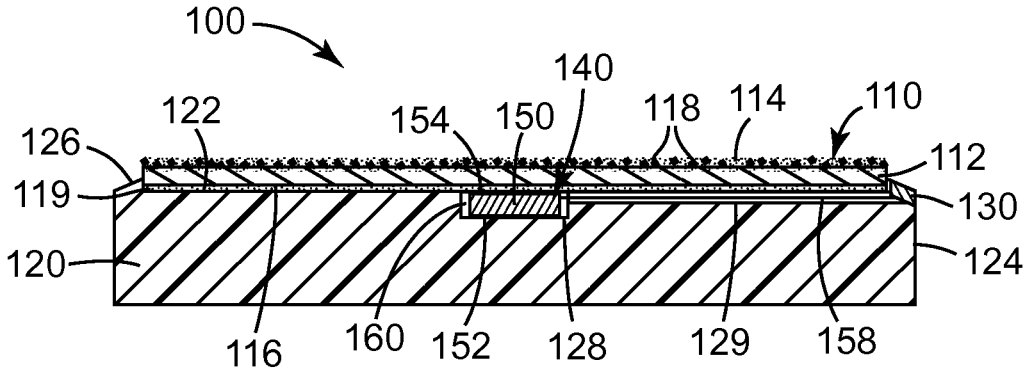
FIG. 2 is a cross-sectional side view of pad conditioner 100 shown in FIG. 1.

Referring now to FIGS. 1 and 2, exemplary cathodically-protected pad conditioner 100 for chemical mechanical planarization comprises abrasive member 110, support carrier 120, anode 130, and cathodic protection circuit 140. Abrasive member 110 comprises metallic substrate 112 which has abrasive surface 114 and back surface 116 opposite abrasive surface 114. Abrasive surface 114 comprises abrasive particles 118 affixed to metallic substrate 112. Support carrier 120 has receiving surface 122 and peripheral edge 124 adjacent to receiving surface 122. Receiving surface 122 is affixed and adjacent to back surface 116 of abrasive member 110 by layer of conductive adhesive 119. Anode 130 is affixed to peripheral edge 124. Cathodic protection circuit 140 is configured to provide a cathodic protection current from anode 130 to metallic substrate 112 if contacted with an electrolyte solution.

The metallic substrate includes one or more metals and/or metal alloys, and may include a brazing alloy around the abrasive particles. Examples of suitable metals include stainless steel, chromium, titanium, titanium alloys, zirconium, zirconium alloys, nickel, and alloys thereof. The substrate may be formed by any suitable process including, for example, brazing or electroplating (e.g. of nickel). Exemplary nickel alloys include a nickel alloy including about 80 percent nickel and about 20 percent chrome. The metallic substrate may be rigid, semi-rigid, or flexible, and may be relatively thin (e.g., a foil) or thick, as desired.

The abrasive member can be formed, for example, by sintering a matrix material formed into an appropriate shape (e.g., a disc) with abrasive particles disposed on a major surface of the matrix material. The matrix material comprises a brazing alloy and a sintered corrosion resistant metallic powder. When heated to a predetermined temperature, the brazing alloy becomes liquid and flows around the abrasive particles. In addition, the brazing alloy reacts with and forms a chemical bond with the abrasive particles. In order to form the chemical bond, the composition of the brazing alloy includes an element known to react with the particular abrasive particle, thereby forming the chemical bond. For example, if diamond abrasive particles are used, the brazing alloy may include at least one of the following elements which may react and form a chemical bond with the diamond: chromium, tungsten, cobalt, titanium, zinc, iron, manganese, or silicon. By way of further example, if cubic boron nitride abrasive particles are used, the brazing alloy may include at least one of aluminum, boron, carbon and silicon which may form the chemical bond with the abrasive particles, and if aluminum oxide abrasive particles are used, the brazing alloy may include at least one of aluminum, boron, carbon, and silicon. It will be recognized, however, that the brazing alloy may also contain various inert elements in addition to the element or elements which react with and form the chemical bond with the abrasive particles.

Exemplary abrasive particles include abrasive particles having a Mohs hardness of at least 8 and, more typically, at least 9. Suitable abrasive particles include, for example, fused aluminum oxide, ceramic aluminum oxide, heat treated aluminum oxide, silicon carbide, boron carbide, tungsten carbide, alumina zirconia, iron oxide, diamond (natural and synthetic), ceria, cubic boron nitride (CBN), diamond, garnet, carborundum, boron suboxide, and combinations thereof. The abrasive particles may further include a surface treatment or coating, such as a coupling agent or a metal or ceramic coating. Abrasive particles useful in the present disclosure typically have an average size in a range of from 20 to 1000 micrometers, although other sizes may also be used. More typically, the abrasive particles have an average size of about 45 to 625 micrometers, or about 75 to 300 micrometers.

Typically, the abrasive member is shaped as a disk or annulus or portion thereof, although other shapes may also be used. If multiple abrasive members are mounted on the support carrier, it is desirable that a respective cathodic protection circuit be present for each abrasive member. A portion of the abrasive surface, typically adjacent the edge of the disk, may be substantially free of abrasive particles. Exemplary abrasive disks suitable for use as the abrasive member are also described in U.S. Pat. Nos. 5,620,489 (Tselesin) and 6,123,612 (Goers).

The abrasive member is affixed to the support carrier such that the abrasive surface of the abrasive member is exposed and available for abrading.

The support carrier is adapted to be mountable in a CMP apparatus, with variations in shape and size being dependent on the equipment to be used. Typically, the support carrier is substantially disk-shaped, although this is not a requirement. The support carrier has a receiving surface and a peripheral edge. In some embodiments, the peripheral edge includes a beveled portion. The support carrier may be formed of, for example, synthetic polymeric materials (e.g., plastics or thermosets), ceramic materials, and/or suitable corrosion resistant metals. In one exemplary embodiment, the support carrier is formed of polycarbonate.

The abrasive member can be affixed to the support carrier using any suitable fastening technique including, for example, adhesives (e.g., conductive adhesives) and/or mechanical fasteners provided that sufficient cathodic protection circuitry is maintained.

The selection of material for the anode will be influenced by the materials used in the CMP process, and is within the ability of those skilled in the art. Exemplary anodes include those anodes known for impressed current cathodic protection (ICCP). The anode may have any shape that does not interfere unduly with the abrading function of the abrading member. Typically, at least a portion of the anode is mounted on the support carrier at about the same height as the abrasive surface, such that the slurry will be able to simultaneously contact the anode and metallic substrate during the CMP process. Moreover, the distance between the anode and the metallic substrate should typically be substantially minimized in order to avoid excessive voltage drop when current passes through the slurry. For example, anode 130 may be mounted to beveled portion 126 (i.e., chamfer) of peripheral edge 124 as shown in FIG. 1. Exemplary suitable anode materials include: mixed metal oxides; platinum; platinized titanium, tantalum, and/or niobium; gold; palladium; silver-palladium; and graphite. Graphite has a low potential for adverse contamination of the wafer during processing but is more prone to environmental deterioration, especially in low pH aqueous environments.

The anode must be insulated from the metallic substrate or a short circuit will result. Accordingly, it may be necessary to place the anode on an insulating pad or otherwise insulate it from the support carrier if the support carrier is conductive. If the support carrier is a dielectric material (e.g., an insulator), this is typically not a concern. The anode may be affixed to the support carrier by any suitable means including, for example, adhesives and/or mechanical fasteners.

The principle of cathodic protection is that by connecting an external anode to the material to be protected from corrosion, and passing of an electrical DC current of sufficient strength and voltage, all areas of the material become cathodic and do not corrode. As practiced in the present disclosure, this is achieved by a cathodic protection circuit.

The cathodic protection circuit electrically couples the anode to the positive terminal of an electric cell while electrically coupling the metallic substrate of the abrasive member to the negative terminal of the electric cell. When not in use, the circuit is open. During use, electrolyte in the slurry used in the CMP process closes the circuit by bridging the metallic substrate and the anode. Referring now to FIG. 2, an exemplary cathodic protection circuit 140 includes electric cell 150, anode 130, and metallic substrate 112. Electric cell 150, which is disposed within cavity 128, includes negative terminal 152 and positive terminal 154 that are electrically coupled to anode 130 through insulated wires 158 disposed in channel 129 adjacent cavity 128. To prevent contamination (e.g., by the slurry during CMP), residual space in channel 129 and cavity 128 are typically filled with a corrosion resistant electrically insulating material 160 such as, for example, a thermosetting silicone resin available as 3M ESPE VINYL POLYSILOXANE IMPRESSION MATERIAL from 3M Company of Saint Paul, Minn. The shape of cavity 128 may vary depending on the type and number of electric cells used.

Figure 3:
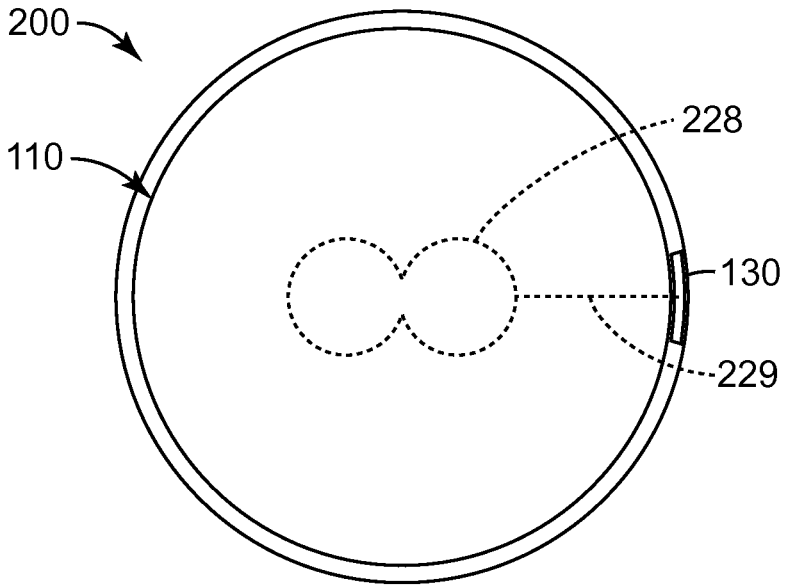
FIG. 3 is a schematic top view of an exemplary pad conditioner 200.
Figure 4:
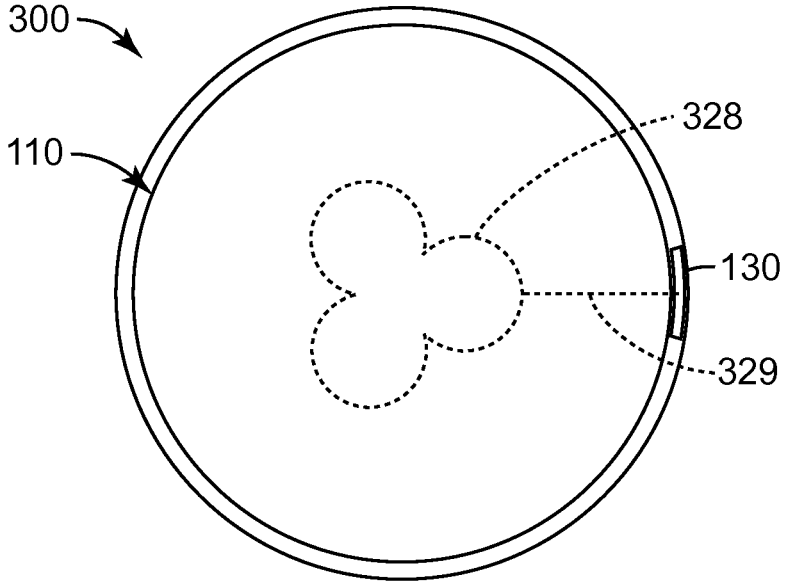
FIG. 4 is a schematic top view of an exemplary pad conditioner 300.

Referring now to FIG. 3, exemplary pad conditioner 200 has abrasive member 110, anode 130, and cavity 228, adapted to contain two coin cells (not shown) and adjacent channel 229. Similarly, as shown in FIG. 4, another exemplary pad conditioner 300 has abrasive member 110, anode 130, and cavity 328, adapted to contain three coin cells (not shown) and adjacent channel 329.

As shown in FIG. 2, electric cell 150 is a coin cell, although other cell designs are also useful. The selection of voltage for the electric cell is typically influenced by the composition of the metallic substrate and design parameters of the pad conditioner; for example, as discussed hereinbefore. Generally, the voltage of the electric cell should be sufficient to reduce oxidized metal species resulting from the metallic matrix. Typically, an electric cell with a voltage of at least 3 volts, 6 volts, or more is sufficient for many implementations of the cathodically protected pad conditioners, although lesser voltages may be useful in certain implementations. In addition, the electric cell is typically selected to have sufficient current capacity to last for the useful life of the cathodically protected pad conditioner, although this is not a requirement.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Example 1

A 4.25-inch (10.8-cm) diameter cathodically-protected pad conditioner was prepared generally as shown in FIGS. 1 and 2. The support carrier was made of polycarbonate. The anode was made of Ag—Pd alloy. 3M ESPE VINYL POLYSILOXANE IMPRESSION MATERIAL from 3M Company of Saint Paul, Minn., was used to fill void space in the channel and cavity of the carrier support around the insulated wires and electric cell. A 3-volt coin cell was used as the electric cell. Conductive adhesive available as 3M XYZ/ISOTROPIC ELECTRICALLY CONDUCTIVE ADHESIVE TRANSFER TAPE 9709S from 3M Company was used to bond the positive terminal of the electric cell to the back surface of the abrasive member. The abrasive member was substantially the same as the abrasive member used in a 3M A188 DIAMOND PAD CONDITIONER marketed by 3M Company. The 3M A188 DIAMOND PAD CONDITIONER has the abrasive member, which can be removed and cleaned, attached by means of a pressure-sensitive adhesive to a polycarbonate carrier. The metal matrix of the abrasive member is composed primarily of nickel, includes chromium as a minor alloying element, and may contain other minor components and impurities such as P, Si, Fe, C, and Mn.

Comparative Pad Conditioner

A pad conditioner was prepared as in Example 1, but without the electric cell.

The comparative pad conditioner and the pad conditioner of Example 1 were separately contacted with a CMP polishing slurry available as SEMI-SPERSE W2000-POLISHING SLURRY FOR ADVANCED TUNGSTEN CMP from Cabot Microelectronics of Aurora, Ill., such that the slurry formed an electrical bridge between the anode and the metallic substrate of the abrasive member (i.e., the cathodic protection circuit was closed). Nickel ion concentration in the slurry was monitored over time using dimethylglyoxime $Ni^{2+}$ complex test strips. Results are reported in Table 1, below.

TABLE 1

| | PAD CONDITIONER | | | |
|---|---|---|---|---|
| | Comparative Pad | Example 1 | | |
| Duration, hours | Conditioner $Ni^{2+}$ concentration, milligrams/liter | $Ni^{2+}$ concentration, milligrams/liter | Voltage, volts | Current, amperes |
| 0 | 0 | 0 | 3.0 | 0.22 |
| 8 | ~10 | 0 | | |
| 24 | ~25 | ~10 | 2.9 | 0.12 |
| 32 | ~100 | ~10 | | |
| 48 | ~250 | ~10 | 2.9 | 0.12 |

All patents and publications referred to herein are hereby incorporated by reference in their entirety. All examples given herein are to be considered non-limiting unless otherwise indicated. Various modifications and alterations of this disclosure may be made by those skilled in the art without departing from the scope and spirit of this disclosure, and it should be understood that this disclosure is not to be unduly limited to the illustrative embodiments set forth herein.

What is claimed is:

1. A cathodically-protected pad conditioner for chemical mechanical planarization comprising:

an abrasive member comprising a metallic substrate having an abrasive surface and a back surface opposite the abrasive surface, wherein the abrasive surface comprises abrasive particles affixed to the metallic substrate;

a support carrier having a receiving surface and a peripheral edge adjacent the receiving surface, wherein the receiving surface is affixed and adjacent to the back surface of the abrasive member;

an anode affixed to the peripheral edge; and a cathodic protection circuit configured to provide a cathodic protection current from the anode to the metallic substrate if contacted with an electrolyte solution that bridges the metallic substrate and the anode.

2. The cathodically-protected pad conditioner of claim 1, wherein the cathodic protection circuit comprises an electric cell having a positive terminal and a negative terminal, wherein the positive terminal is electrically coupled to the anode, and wherein the negative terminal is electrically coupled to the metallic substrate.

3. The cathodically-protected pad conditioner of claim 2, wherein the electric cell is at least partially disposed within a cavity in the support carrier.

4. The cathodically-protected pad conditioner of claim 2, wherein the negative terminal is at least partially affixed to the metallic substrate by conductive adhesive.

5. The cathodically-protected pad conditioner of claim 1, wherein the peripheral edge has a beveled portion adjacent the abrasive member, and wherein the anode is disposed on the beveled portion.

6. A method of conditioning a pad, the method comprising using the cathodically-protected pad conditioner of any one of claims 1 to 5 to condition the pad during chemical mechanical planarization of a semiconductor wafer.

7. The method of claim 6, wherein the cathodically-protected pad conditioner contacts and conditions the pad during chemical mechanical planarization of a semiconductor wafer.

* * * * *